US012053135B2

(12) United States Patent
Ohayon et al.

(10) Patent No.: US 12,053,135 B2
(45) Date of Patent: Aug. 6, 2024

(54) DISHWASHING APPLIANCE VENT CONDUIT

(71) Applicant: Haier US Appliance Solutions, Inc., Wilmington, DE (US)

(72) Inventors: Tal Abraham Ohayon, Louisville, KY (US); Brian Steven Riddle, Taylorsville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/689,167

(22) Filed: Mar. 8, 2022

(65) Prior Publication Data

US 2023/0284865 A1 Sep. 14, 2023

(51) Int. Cl.
*A47L 15/48* (2006.01)
*A47L 15/42* (2006.01)

(52) U.S. Cl.
CPC ..... *A47L 15/488* (2013.01); *A47L 15/4257* (2013.01); *A47L 15/486* (2013.01)

(58) Field of Classification Search
CPC ... A47L 15/488; A47L 15/486; A47L 15/4257
See application file for complete search history.

(56) References Cited

U.S. PATENT DOCUMENTS 4,657,036 A * 4/1987 Yake ..... A47L 15/488 134/115 R
7,875,122 B2 1/2011 Gonska et al.
9,364,134 B2 6/2016 Kim
9,795,275 B2 10/2017 Hahm et al.
10,506,912 B2 12/2019 Kopera et al.
2007/0251552 A1* 11/2007 Lee ..... A47L 15/481 134/56 D
2008/0072935 A1 3/2008 Han et al.
2012/0055519 A1* 3/2012 Hong ..... A47L 15/481 134/107
2014/0360534 A1* 12/2014 Olson ..... F24F 7/007 454/251
2015/0068056 A1* 3/2015 Jung ..... A47L 15/4217 34/218

(Continued)

FOREIGN PATENT DOCUMENTS

CN 105796033 A * 7/2016
CN 108618733 A 10/2018

(Continued)

*Primary Examiner* — Joseph L. Perrin
*Assistant Examiner* — Irina Graf
(74) *Attorney, Agent, or Firm* — Dority & Manning, P.A.

(57) ABSTRACT

A method of assembling a dishwashing appliance includes selecting one fan cover from a plurality of fan covers. Each fan cover of the plurality of fan covers is configured to be removably mounted in a vent conduit. The plurality of fan covers are each interchangeable with every other fan cover of the plurality of fan covers. The method also includes mounting the selected fan cover removably in the vent conduit. Such mounting results in the formation of a flow path for air from an ambient environment outside of the dishwashing appliance through the vent conduit and the fan cover. The flow path for air from the ambient environment is partially defined by a wall of the fan cover.

16 Claims, 12 Drawing Sheets

(56) References Cited

U.S. PATENT DOCUMENTS

| | | | | |
|---|---|---|---|---|
| 2015/0257627 | A1* | 9/2015 | Park | A47L 15/483 34/72 |
| 2016/0022116 | A1* | 1/2016 | Delellis | A47L 15/486 34/218 |
| 2019/0335974 | A1 | 11/2019 | Kopera et al. | |
| 2020/0100644 | A1 | 4/2020 | Kopera | |
| 2021/0015338 | A1* | 1/2021 | Büsing | A47L 15/488 |
| 2021/0100424 | A1* | 4/2021 | Tan | A47L 15/488 |

FOREIGN PATENT DOCUMENTS

| | | | | | |
|---|---|---|---|---|---|
| CN | 209996270 | U | * | 1/2020 | |
| CN | 111588331 | A | * | 8/2020 | |
| CN | 111802996 | A | * | 10/2020 | |
| CN | 105942952 | B | * | 5/2021 | A47L 15/4246 |
| CN | 113040685 | A | * | 6/2021 | |
| CN | 113331760 | A | * | 9/2021 | |
| EP | 3020319 | A1 | * | 5/2016 | A47L 15/486 |
| GB | 2308431 | A | | 6/1997 | |
| WO | WO-2009008828 | A1 | * | 1/2009 | A47L 15/4287 |
| WO | WO2019141187 | A | | 7/2019 | |

* cited by examiner

DISHWASHING APPLIANCE VENT CONDUIT

FIELD OF THE INVENTION

The present subject matter relates generally to dishwashing appliances, and more particularly to features for promoting ventilation in dishwashing appliances.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. Dishwashing appliances are also typically equipped with one or more pumps, such as a circulation pump or a drain pump, for directing or motivating wash liquid from the sump to, e.g., the spray assemblies or an area outside of the dishwashing appliance.

Various cycles may be included as part of the overall cleaning process. For example, a typical, user-selected cleaning option may include a wash cycle and rinse cycle (referred to collectively as a wet cycle), as well as a drying cycle. In the drying cycle, air may be introduced into the wash chamber to promote drying of articles therein. Some air introduction assemblies include multiple fans to motivate air through the wash chamber, which provides increased air flow, but also comes at an increased cost. Other air introduction assemblies include only a single fan, which reduces the cost but also may incur a reduction in ventilation performance. Moreover, the need to accommodate varying numbers of fans within different models of dishwashing appliance may result in increased complexity in manufacturing and reduced cross-compatibility of parts.

Accordingly, dishwashing appliances and ventilation assemblies therefor that include features for interchangeably accommodating varying numbers of fans would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of assembling a dishwashing appliance is provided. The method includes selecting one fan cover from a plurality of fan covers. Each fan cover of the plurality of fan covers is configured to be removably mounted in a vent conduit. The plurality of fan covers are each interchangeable with every other fan cover of the plurality of fan covers. The method further includes removably mounting the selected fan cover in the vent conduit, thereby forming a flow path for air from an ambient environment outside of the dishwashing appliance through the vent conduit and the fan cover. The flow path for air from the ambient environment is partially defined by a wall of the fan cover.

In another exemplary aspect of the present disclosure, a dishwashing appliance is provided. The dishwashing appliance includes a tub defining a wash chamber therein for receipt of articles for washing. A sump is positioned at a bottom of the wash chamber for receiving fluid from the wash chamber. The dishwashing appliance also includes a vent conduit in fluid communication with the wash tub and the sump and with an ambient environment outside of the dishwashing appliance. The vent conduit is configured to removably receive a selected fan cover. The selected fan cover is one of a plurality of fan covers and each fan cover of the plurality of fan covers includes a wall defining a flow path for air from the ambient environment through the respective fan cover of the plurality of fan covers.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
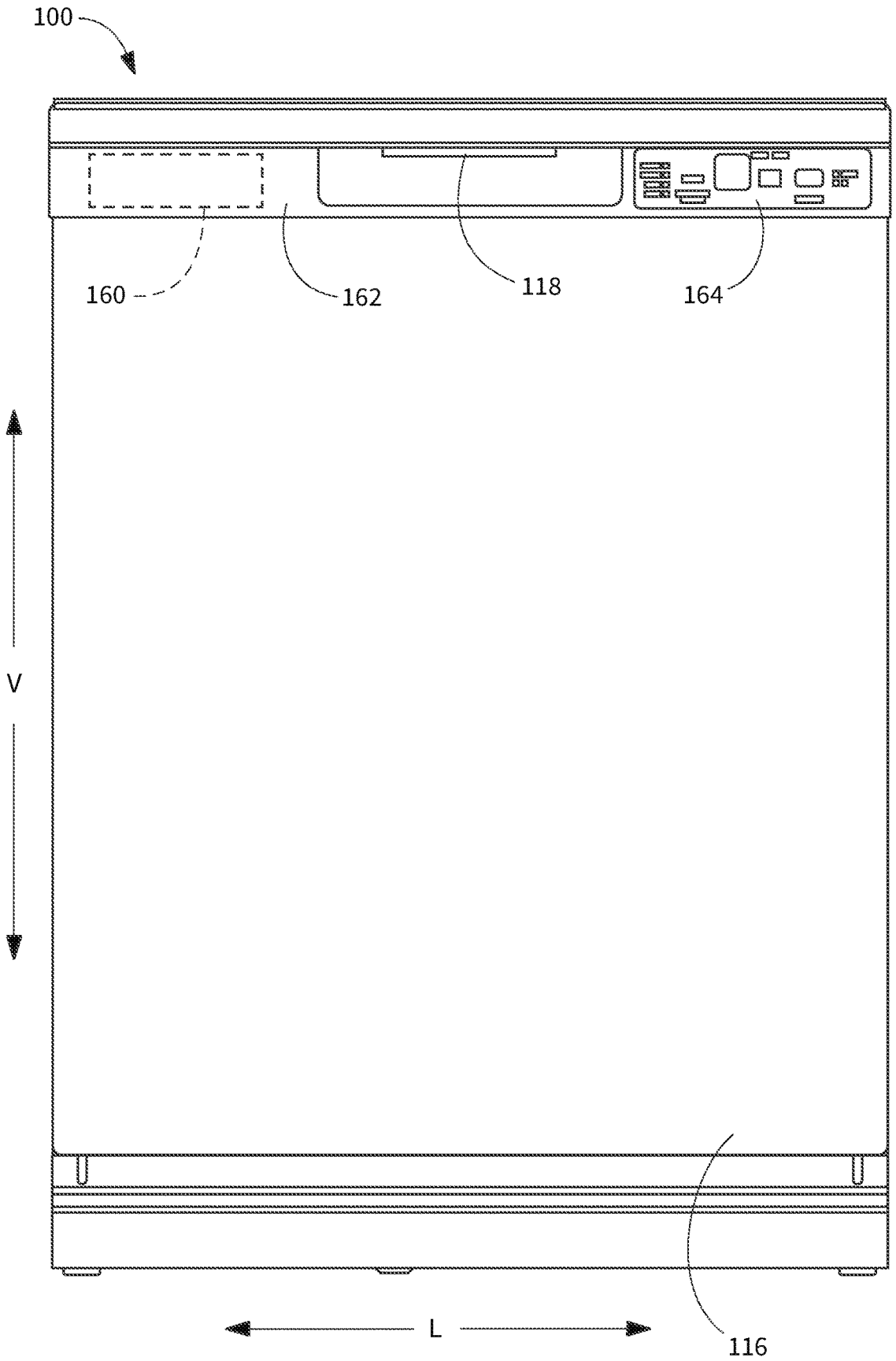
FIG. 1 provides a front view of an exemplary embodiment of a dishwashing appliance of the present disclosure.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is used to refer to an overall operation of the dishwashing appliance which may include two or more distinct phases. The term "wash phase" is intended to refer to one or more periods of time during which a dishwashing appliance operates while containing the articles to be washed and uses a wash liquid (e.g., water, detergent, or wash additive) and may be a portion of the wash cycle, such as a beginning or early portion of the wash cycle. The term "rinse phase" is intended to refer to one or more periods of time during which the dishwashing appliance operates to remove residual soil, detergents, and other undesirable elements that were retained by the articles after completion of the wash phase and may be a portion of the wash cycle, such as an intermediate portion of the wash cycle. The term "drain phase" is intended to refer to one or more periods of time during which the dishwashing appliance operates to discharge soiled water from the dishwashing appliance and may be a portion of the wash cycle, such as a later portion of the wash cycle. The term "wash liquid" refers to a liquid used for washing or rinsing the articles that is typically made up of water and may include additives, such as detergent or other treatments (e.g., rinse aid). Furthermore, as used herein, terms of approximation, such as "generally," "approximately," "substantially," or "about," refer to being within a ten percent (10%) margin of error. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
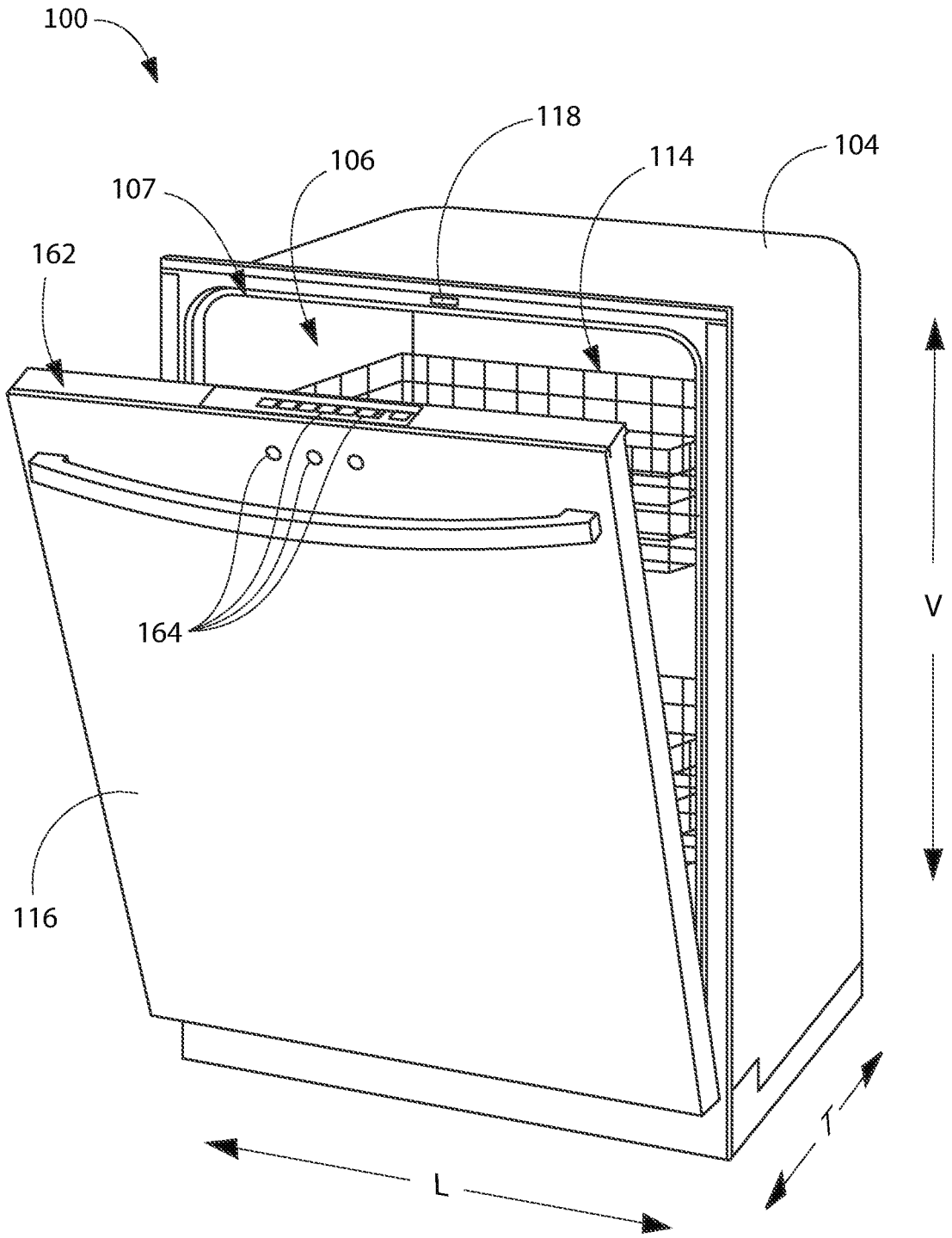
FIG. 2 provides a perspective view of an additional exemplary embodiment of a dishwashing appliance of the present disclosure with a door in an intermediate position.
Figure 3:
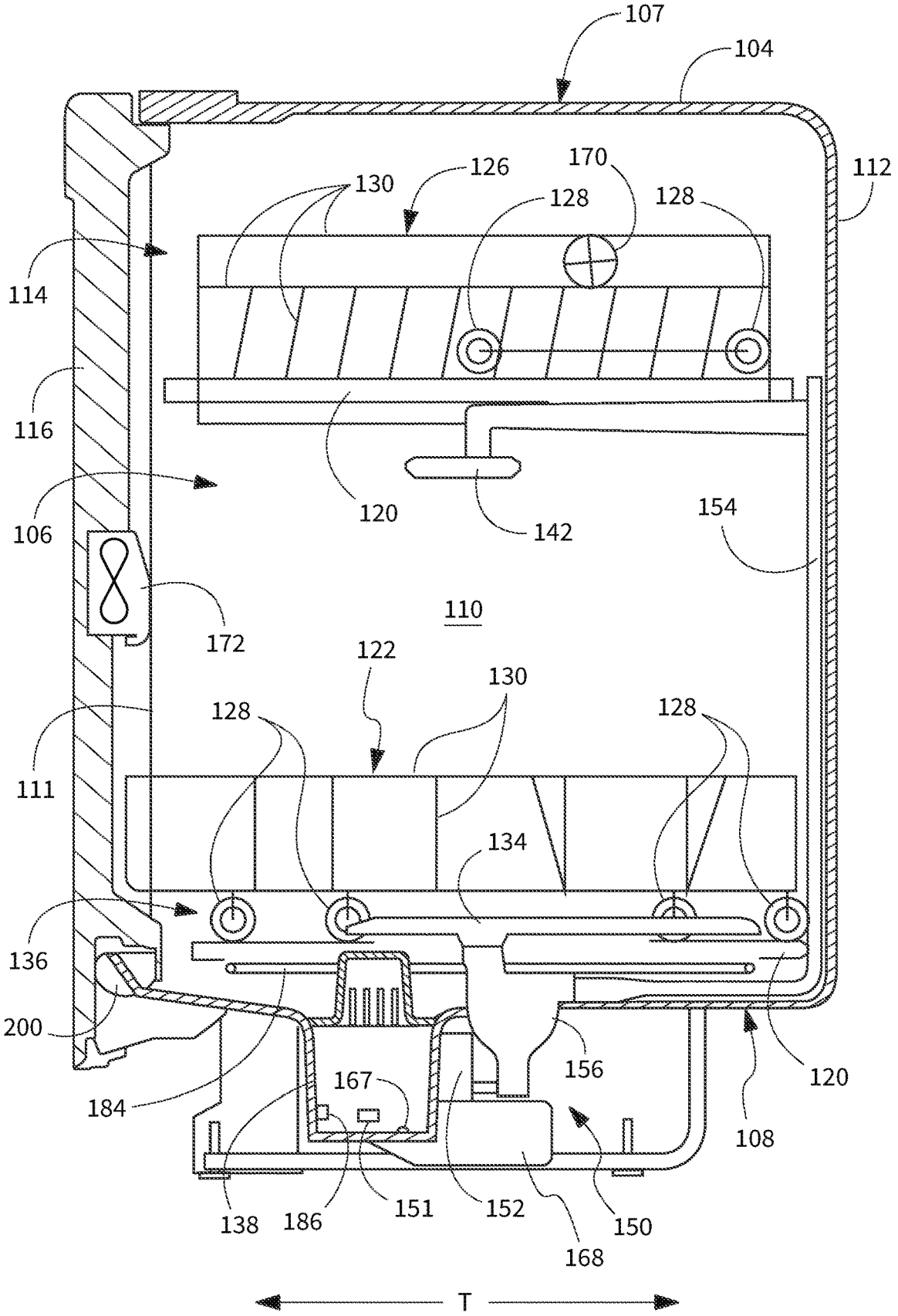
FIG. 3 provides a side, cross section view of an exemplary dishwashing appliance, such as the dishwashing appliance of FIG. 1 or FIG. 2.

Turning now to the figures, FIGS. 1 through 3 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a tub 104 that defines a wash chamber 106 therein. As shown in FIG. 3, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114 at the front side 111. In some embodiments, the dishwashing appliance 100 may also include a door 116 at the front opening 114. The door 116 may, for example, be coupled to the tub 104 by a hinge 200 at its bottom for movement between a normally closed vertical position (FIGS. 1 and 3), wherein the wash chamber 106 is sealed shut for washing operation, and a horizontal open position (not shown) for loading and unloading of articles from dishwasher 100. A door closure mechanism or assembly 118, e.g., a latch, may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122 and an upper rack assembly 126. In some such embodiments, upper rack assembly 126 is positioned at a top portion of wash chamber 106 above lower rack assembly 122 along the vertical direction V.

Generally, each rack assembly 122, 126 may be adapted for movement between an extended loading position (not shown) in which the rack is substantially positioned outside the wash chamber 106, and a retracted position (shown in FIGS. 1 through 3) in which the rack is located inside the wash chamber 106. In some embodiments, movement is facilitated, for instance, by rollers 128 mounted onto rack assemblies 122, 126, respectively.

Although guide rails 120 and rollers 128 are illustrated herein as facilitating movement of the respective rack assemblies 122, 126, it should be appreciated that any suitable sliding mechanism or member may be used according to alternative embodiments.

In optional embodiments, some or all of the rack assemblies 122, 126 are fabricated into lattice structures including a plurality of wires or elongated members 130 (for clarity of illustration, not all elongated members making up rack assemblies 122, 126 are shown). In this regard, rack assemblies 122, 126 are generally configured for supporting articles within wash chamber 106 while allowing a flow of wash liquid to reach and impinge on those articles (e.g., during a cleaning or rinsing phase of the wash cycle). According to additional or alternative embodiments, a silverware basket (not shown) may be removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash liquid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122. In this regard, lower spray arm assembly 134 may generally be configured for urging a flow of wash liquid up through lower rack assembly 122.

In some embodiments, an upper spray assembly 142 may be located proximate to and, e.g., below, upper rack assembly 126 along the vertical direction V. In this manner, upper spray assembly 142 may be generally configured for urging of wash liquid up through upper rack assembly 126.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be mounted to sump 138 and in fluid communication with the sump 138 through a circulation outlet 151 from the sump 138.

When assembled, circulation pump 152 may be in fluid communication with an external water supply line (not shown) and sump 138. A water inlet valve (not shown) can be positioned between the external water supply line and circulation pump 152 (e.g., to selectively allow water to flow from the external water supply line to circulation pump 152). Additionally or alternatively, water inlet valve can be positioned between the external water supply line and sump 138 (e.g., to selectively allow water to flow from the external water supply line to sump 138). During use, water inlet valve may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 3, a primary supply conduit 154 extends from circulation pump 152, along rear side 112 of tub 104 along the vertical direction V to supply wash liquid throughout wash chamber 106.

In optional embodiments, circulation pump 152 urges or pumps wash liquid to a diverter 156 (FIG. 3). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 142, or other spray manifolds or assemblies. For instance, the diverter disk may have at least one aperture configured to align with one or more outlet ports (not shown) at the top of diverter chamber 158. In this manner, the diverter disk may be selectively rotated to provide wash liquid to the desired spray device(s).

In exemplary embodiments, diverter 156 is configured for selectively distributing the flow of wash liquid from circulation pump 152 to various fluid supply conduits—only some of which are illustrated in FIG. 3 for clarity. In certain embodiments, diverter 156 includes two or more outlet ports (not shown) for supplying wash liquid to a first conduit for rotating lower spray arm assembly 134 and a second conduit for supplying upper spray assembly 142 (e.g., supply conduit 154). Additional embodiments may also include one or more additional conduits, e.g., a third conduit for spraying an auxiliary rack such as a silverware rack, etc.

In some embodiments, a supply conduit 154 is used to supply wash liquid to one or more spray assemblies (e.g., to upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, supply conduit 154 could be used to provide wash liquid to lower spray arm assembly 134 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray assembly 134 and 142, or other spray device as may be included in dishwashing appliance 100, may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 142 may be motor-driven, or may operate using any other suitable drive mechanism. Spray manifolds and assemblies may also be stationary. The resultant movement of the spray assemblies 134, 142 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

Drainage of soiled wash liquid within sump 138 may by provided, for instance, by a drain pump 168 (e.g., during or as part of a drain phase). In particular, wash liquid may exit sump 138 through a drain outlet 167 and may flow through a drain conduit or directly to the drain pump 168. Thus, drain pump 168 is downstream of sump 138 and facilitates drainage of the soiled wash liquid by urging or pumping the wash liquid to a drain line external to dishwasher 100.

In some embodiments, a filter assembly may be provided, e.g., in the sump 138 and/or at a top entrance into the sump 138, e.g., to filter fluid to circulation assembly 150 and/or drain pump 168. Generally, the filter assembly removes soiled particles from the liquid that flows to the sump 138 from the wash chamber 106 during operation of dishwashing appliance 100. In exemplary embodiments, the filter assembly may include both a first filter (also referred to as a "coarse filter") and a second filter (also referred to as a "fine filter").

Although a separate circulation pump 152 and drain pump 168 are described herein, it is understood that other suitable pump configurations (e.g., using only a single pump for both recirculation and draining) may be provided.

The dishwashing appliance 100 may further include a heating element 184, such as a resistance heating element, positioned in or near the sump 138. For example, the heating element 184 may be positioned "near" the sump 138 in that the heating element 184 is disposed above the sump 138 and within the lower region 136 of wash chamber 106, such as below the lower spray arm 134 and/or below the lower rack assembly 122. The heating element 184 may be positioned and configured to heat liquid in the sump 138, such as for a heated wash phase, and/or to heat air within the wash chamber 106, such as for drying articles during a dry phase.

Dishwashing appliance 100 may also include ventilation features, e.g., to promote improved, e.g., more rapid, drying of articles therein after the wash and rinse phases. For example, one or more vents 170 may be provided in the tub 104 for introducing relatively dry air from outside of the tub 104 into the wash chamber 106 and/or for removing relatively humid air from the wash chamber 106 to the outside of the tub 104. In some embodiments, a fan 172 may be provided. The fan 172 may be operable to urge air through the wash chamber 106, such as to promote air circulation and/or ventilation within and through the wash chamber. Such air movement may increase the rate of evaporation of moisture from articles in the wash chamber 106 after a wash and/or rinse phase.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation or wash cycle that may include a pre-wash phase, a wash phase, a rinse phase, a drain phase, and/or a dry phase. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

Controller 160 may be positioned in a variety of locations throughout dishwasher 100. In optional embodiments, controller 160 is located within a control panel area 162 of door 116 (e.g., as shown in FIG. 1 or FIG. 2). Input/output ("I/O") signals may be routed between the control system and various operational components of dishwasher 100 along wiring harnesses that may be routed through the bottom of door 116. Typically, the controller 160 includes or is operatively coupled to a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electro-mechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

The dishwashing appliance 100 may also include a temperature sensor 186 in operative communication with the controller 160. For example, in some embodiments, the temperature sensor 186 may be located in the sump 138 and may thereby be operable to measure a temperature of a liquid, e.g., wash liquid, within the sump 138. For example, the "temperature sensor" may include any suitable type of temperature measuring system or device positioned at any suitable location for measuring the desired temperature. Thus, for example, temperature sensor 186 may be any suitable type of temperature sensor, such as a thermistor, a thermocouple, a resistance temperature detector, a semiconductor-based integrated circuit temperature sensor, etc. In addition, temperature sensor 186 may be positioned at any suitable location and may output a signal, such as a voltage, to the controller 160 that is proportional to and/or indicative of the temperature being measured. Although exemplary positioning of the temperature sensor 186 is described herein and depicted in FIG. 3, it should be appreciated that dishwashing appliance 100 may include any other suitable number, type, and position of temperature, humidity, and/or other sensors as well as or instead of the exemplary temperature sensor 186 according to alternative embodiments.

It should be appreciated that the invention is not limited to any particular style, model, or configuration of dishwasher 100. The exemplary embodiments depicted in FIGS. 1 through 3 are for illustrative purposes only. For instance, different locations may be provided for control panel area 162 (e.g., on the front of the door 116 as illustrated in FIG. 1 or on the top of the door 116 as illustrated in FIG. 2, or other locations as well), different configurations may be provided for rack assemblies 122, 126, different spray assemblies 134, 142 and spray manifold configurations may be used, different sensors may be used, and other differences may be applied while remaining within the scope of the present disclosure.

In some embodiments, the dishwashing appliance may include a ventilation assembly which includes a vent conduit and a plurality of interchangeable fan covers, where each fan cover, e.g., a selected one of the plurality of fan covers, may be removably mounted within the vent conduit. As such, the single vent conduit may be used with various models or types of dishwashing appliances, such as with a first fan cover for dishwashing appliances having only one fan in the ventilation assembly and with a second fan cover, mutually interchangeable with the first fan cover, for dishwashing appliances having multiple fans in the ventilation assembly. Additionally, it should be understood that embodiments having only a single fan in the ventilation assembly may also include additional fans in the dishwashing appliance and outside of the ventilation assembly, although the presence of such additional fans outside of the ventilation assembly is not necessarily required in single-fan ventilation assembly embodiments.

The interchangeability of the fan covers may be provided by various features of the plurality of fan covers that are standardized across all of the fan covers. For example, the fan covers may all have the same outer peripheral shape and size and dimensions. As another example, the fan covers may each be configured for being removably received within the vent conduit, such as removably mounted within the vent conduit. Such configuration may include mounting means, such as hooks, latches, tabs, etc., which are positioned at the same locations, e.g., along one or more outer peripheral edges, on each fan cover for engaging with corresponding structures, e.g., slots, notches, tabs, etc., in the vent conduit. As a result of this positioning of the mounting means, each fan cover may fit into the vent conduit in the same position and in the same way regardless of the internal variations of each fan cover, such as the number of fans therein and/or the number and position of walls therein.

Figure 4:
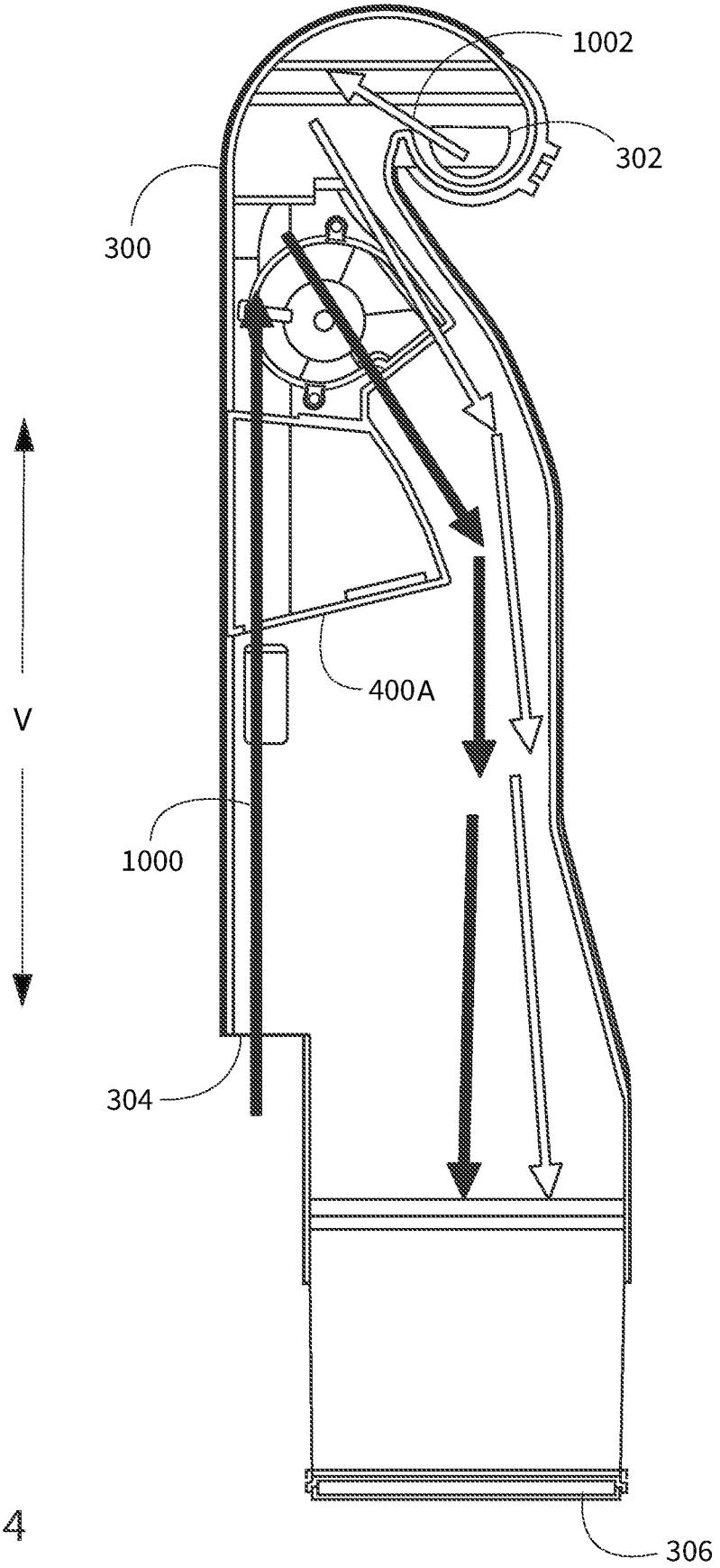
FIG. 4 provides a schematic diagram of multiple air flow streams through an exemplary vent conduit according to one or more embodiments of the present disclosure which may be incorporated into a dishwashing appliance such as the exemplary dishwashing appliance of FIGS. 1 through 3.
Figure 5:
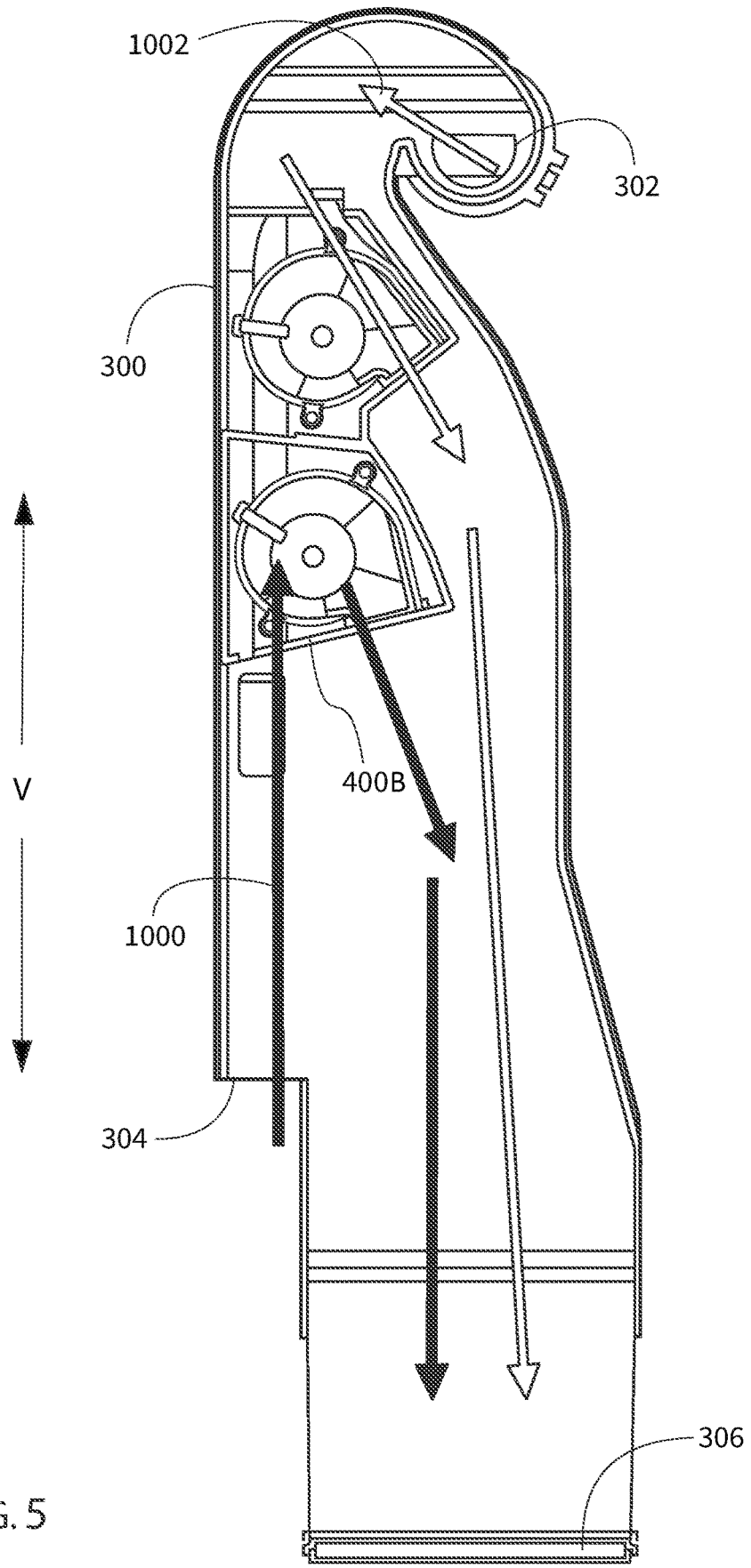
FIG. 5 provides a schematic diagram of multiple air flow streams through another exemplary vent conduit according to one or more additional embodiments of the present disclosure which may be incorporated into a dishwashing appliance such as the exemplary dishwashing appliance of FIGS. 1 through 3.

FIGS. 4 and 5 illustrate an exemplary vent conduit 300 which may be incorporated into a dishwashing appliance such as the dishwashing appliance 100 of FIGS. 1-3. In FIG. 4, the vent conduit 300 has a first fan cover 400A removably mounted therein, whereas in FIG. 5 the vent conduit 300 has a second fan cover 400B removably mounted therein. The first fan cover 400A and the second fan cover 400B are collectively an embodiment of a plurality of interchangeable fan covers as discussed herein. The first fan cover 400A and the second fan cover 400B are similar, e.g., include various features such as size, shape, dimensions, etc., that are the same, in order to promote interchangeability of the first fan cover 400A and the second fan cover 400B.

As may be seen in FIGS. 4 and 5, the vent conduit 300 includes a tub inlet 302. The tub inlet 302 may be coupled to a vent in direct fluid communication with the wash chamber 106 whereby the vent conduit 300 receives air, e.g., hot, humid air, directly from the wash chamber 106 at the tub inlet 302. For example, the vent conduit 300 may be coupled to the vent 170 in side wall 110, or a vent in the door, e.g., the vent conduit 300 may take the place of the fan housing of fan 172 illustrated in FIG. 3. Also by way of example, the vent conduit 300 and fan(s) therein may be provided in addition to the fan 172 of FIG. 3. The vent conduit 300, e.g., the tub inlet 302 thereof, may be directly coupled to the vent without intervening ducts or conduits. The vent conduit 300 may further include a second inlet 304 which is in fluid communication with an ambient environment outside of and around the dishwashing appliance such that a flow of dry air 1000 from the ambient environment enters the vent conduit at the second inlet 304. The exemplary vent conduit 300 also includes an outlet 306. Air and water, e.g., condensation, may exit the vent conduit 300 at the outlet 306, such as from the vent conduit 300 at the outlet 306 to the ambient environment.

Still referring to FIGS. 4 and 5, when installed in the vent conduit 300, each fan cover 400A or 400B may define a flow path for air 1000 from the ambient environment through the fan cover 400A or 400B. In particular, each fan cover 400A or 400B may include a wall 402 (FIGS. 6 and 7) and, when the fan cover 400A or 400B is mounted within the vent conduit 300, the wall 402 partially defines, e.g., forms one boundary of, the flow path for air 1000 from the ambient environment through the fan cover 400A or 400B. Dry air 1000 from the ambient environment and wet air 1002 from the tub may both flow through the fan cover 400A or 400B and the vent conduit 300. It should be understood that the terms "wet," "dry," "hot," and "cool" in the context of the various air streams discussed herein are used with reference to each other. For example, the air 1002 from the tub may be hot and wet and the air 1000 from the ambient environment may be cool and dry in that the air 1002 has a higher temperature and a greater moisture content (e.g., humidity) than the air 1000. The two flows of air 1000 and 1002 may mix within the vent conduit 300, such as downstream of the fan cover 400A or 400B, thus providing an exhaust flow of air to the ambient environment via the outlet 306 of the vent conduit 300 that is drier than the air 1002 from the tub. Additionally, any condensate that may be created due to this mixing may flow to the sump for collection and drainage from the dishwashing appliance.

Referring now specifically to FIG. 4, the first fan cover 400A may define a common flow path therethrough for both the dry air 1000 from the ambient environment and for wet air 1002 from the tub which enters the vent conduit 300 at the tub inlet 302. For example, the first fan cover 400A may define a flow path for air 1000 from the ambient environment that overlaps with a flow path for air 1002 from the wash tub of the dishwashing appliance through the first fan cover 400A defined by the first fan cover 400A. Where the first fan cover 400A includes only a single fan 420 (FIG. 6) therein, the single fan 420 may thereby urge both the dry air 1000 and the wet air 1002 through the first fan cover 400A and into a lower portion of the vent conduit 300, e.g., to or towards the outlet 306 of the vent conduit 300.

Figure 7:
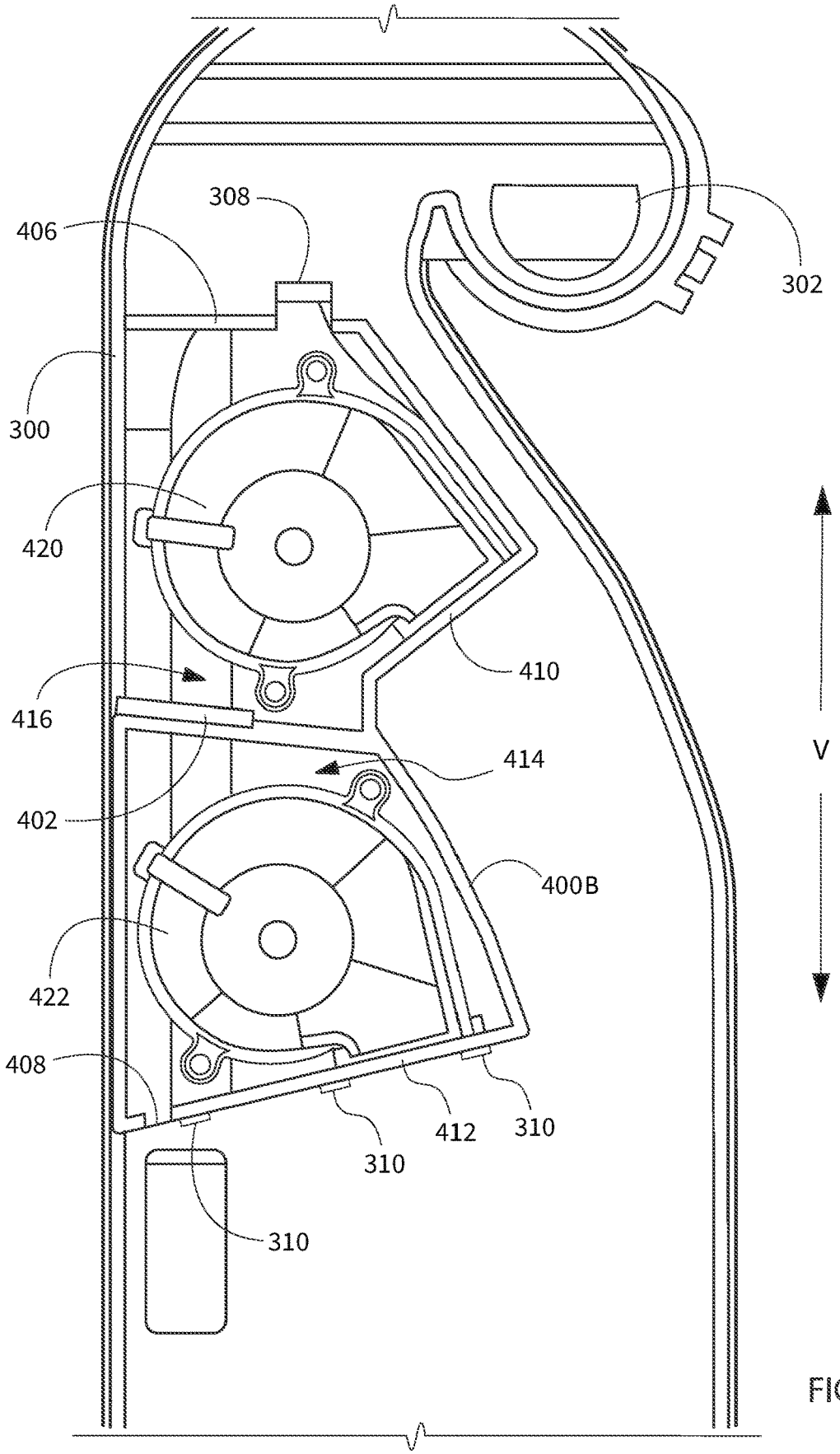
FIG. 7 an enlarged view of a portion of the vent conduit of FIG. 5.

Referring now specifically to FIG. 5, the second fan cover 400B may define separate flow paths therethrough for the dry air 1000 from the ambient environment and for wet air 1002 from the tub where the flow paths are separate and mutually isolated from each other. For example, the second fan cover 400B may define a first flow path therethrough for air 1000 from the ambient environment and a second flow path therethrough for air 1002 from the tub that is separate from the first flow path. The second fan cover 400B may include multiple fans therein, such as a first fan 420 (FIG. 7) and a second fan 422 (FIG. 7). The first fan 420 may thereby urge the wet air 1002 through the second fan cover 400B and the second fan 422 may urge the dry air 1000 through the second fan cover 400B. In some embodiments, the first fan 420 and/or second fan 422 (when provided) may each be centrifugal fans, as illustrated.

Figure 6:
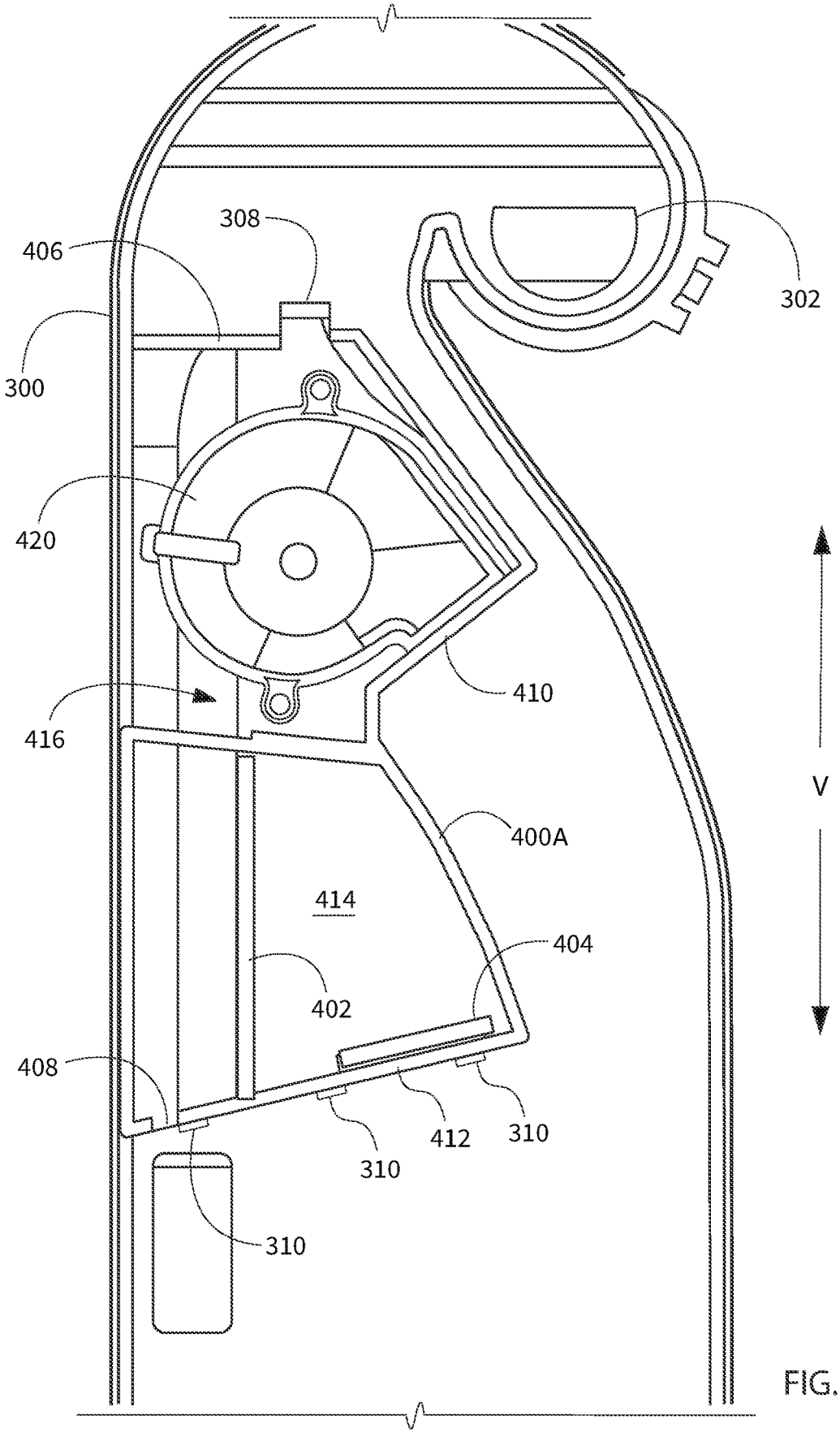
FIG. 6 provides an enlarged view of a portion of the vent conduit of FIG. 4.

Additional features of the first fan cover 400A and second fan cover 400B may be seen in the enlarged views of FIGS. 6 and 7. As may be seen, e.g., in FIGS. 6 and 7, the first fan cover 400A and the second fan cover 400B are generally the same except for the position and location of the wall(s) 402 and/or 404, and the inclusion of second fan 422 in the second fan cover 400B. Still referring to FIGS. 6 and 7 collectively, the first fan cover 400A and the second fan cover 400B may each include a first inlet 406 for tub air 1002 and a second inlet 408 for ambient (outside, as in outside of the dishwashing appliance) air 1000. Internally, each fan cover 400A and 400B may include two distinct chambers or compartments, a dry air compartment 414 and a tub air compartment 416. Each fan cover 400A and 400B may further include a first outlet 410 in the tub air compartment 416, e.g., whereby air from the tub air compartment 416 may exit the fan cover 400A or 400B at the first outlet 410, and a second outlet 412 in the dry air compartment 414, whereby air from the dry air compartment 414 may exit the fan cover 400A or 400B at the second outlet 412.

Also as may be seen in FIGS. 6 and 7, the vent conduit 300 may include features for removably mounting the selected fan cover, e.g., fan cover 400A or 400B, therein. For example, such removable mounting features may include one or more first slots 308 configured for engaging with, e.g., removably receiving, a corresponding removable mounting feature or features of the selected fan cover 400A or 400B, and one or more second slots 310 configured for engaging with, e.g., removably receiving, a corresponding removable mounting feature or features of the selected fan cover 400A or 400B.

Referring now specifically to FIG. 6, the first fan cover 400A may include only a single fan 420 therein and may define a common or overlapping flow path for dry air 1000 from the ambient environment and wet air 1002 from the tub of the dishwashing appliance. As mentioned above, each fan cover 400A or 400B may include a wall 402 which partially defines the flow path for the outside air 1000 through the fan cover 400A or 400B. In the first fan cover 400A, e.g., as illustrated in FIG. 6, the wall 402 may be a first wall 402 and the first fan cover 400A may also include a second wall 404. In the first fan cover 400A, the first wall 402 may be positioned at the second inlet 408 and may extend from the second inlet 408 to the tub air compartment 416. Thus, in the first fan cover 400A, the first wall 402 may obstruct the dry air compartment 414 and prevent air, e.g., air 1000, from flowing into the dry air compartment 414. Thus, in the first fan cover 400A, the first wall 402 defines a flow path through the first fan cover 400A for dry air 1000 that does not include the dry air compartment 414 but instead directs the dry air 1000 to the tub air compartment 416 and the fan 420 therein. In the first fan cover 400A, the second wall 404 may be positioned at and extend across the second outlet 412, thereby reducing or preventing air from exiting the first fan cover 400A at the second outlet 412. As may be seen in FIG. 6, the dry air 1000 joins the tub air 1002 in the tub air compartment 416 in the first fan cover 400A, and both flow paths (for the dry air 1000 and for the tub air (wet air) 1002) exit the first fan cover 400A at the first outlet 410 from the tub air compartment 416.

Turning now to FIG. 7, in the second fan cover 400B the wall 402 may extend across a passage or opening between the dry air compartment 414 and the tub air compartment 416, thereby separating the flow path for dry air 1000 (which enters the fan cover 400A or 400B at the second inlet 408) from the flow path for wet air 1002 through the second fan cover 400B, such that two separate, distinct, and mutually isolated flow paths are defined through the second fan cover 400B for the dry air 1000 and the wet air 1002. In particular, the dry air 1000 enters the second fan cover 400B at the second inlet 408, is drawn into and through the dry air compartment 414 by the second fan 422, and exits the second fan cover 400B at the second outlet 412 from the dry air compartment 414, whereas the wet air 1002 enters the second fan cover 400B at the first inlet 406, is drawn into and through the tub air compartment 416 by the first fan 420, and exits the second fan cover 400B at the first outlet 410 from the tub air compartment 416.

Figure 8:
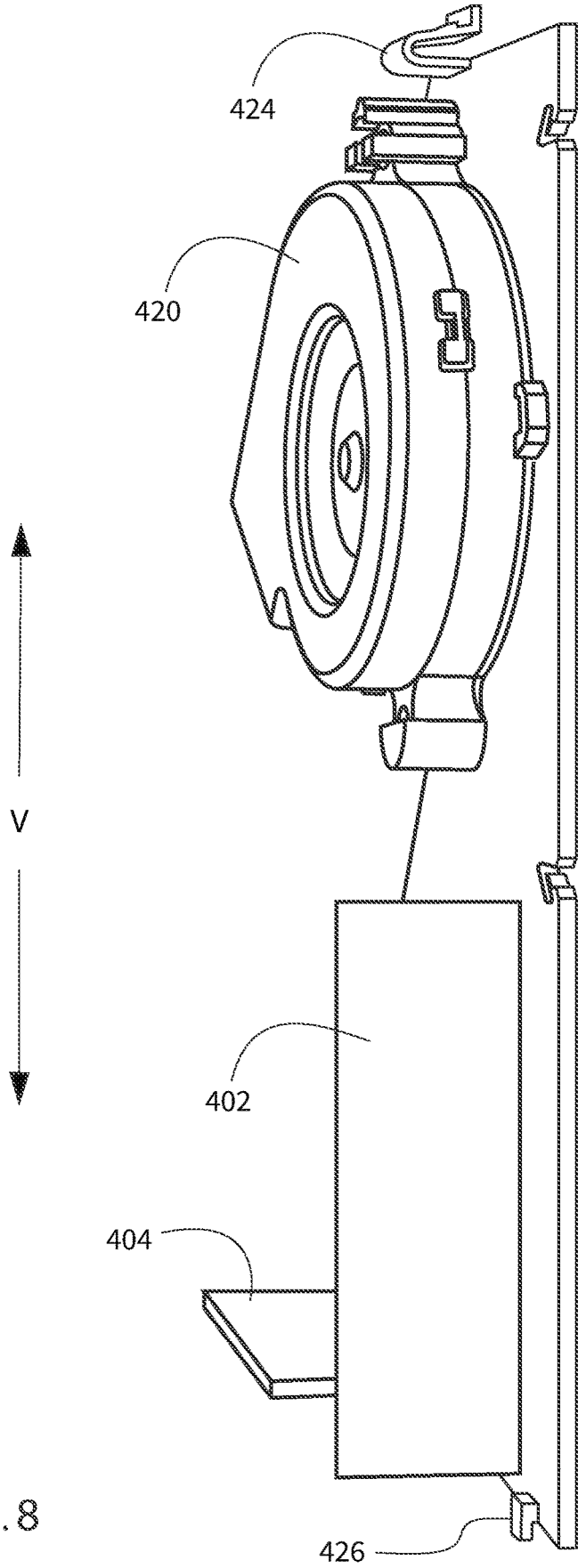
FIG. 8 provides a perspective view of an exemplary fan cover of FIGS. 4 and 6.
Figure 9:
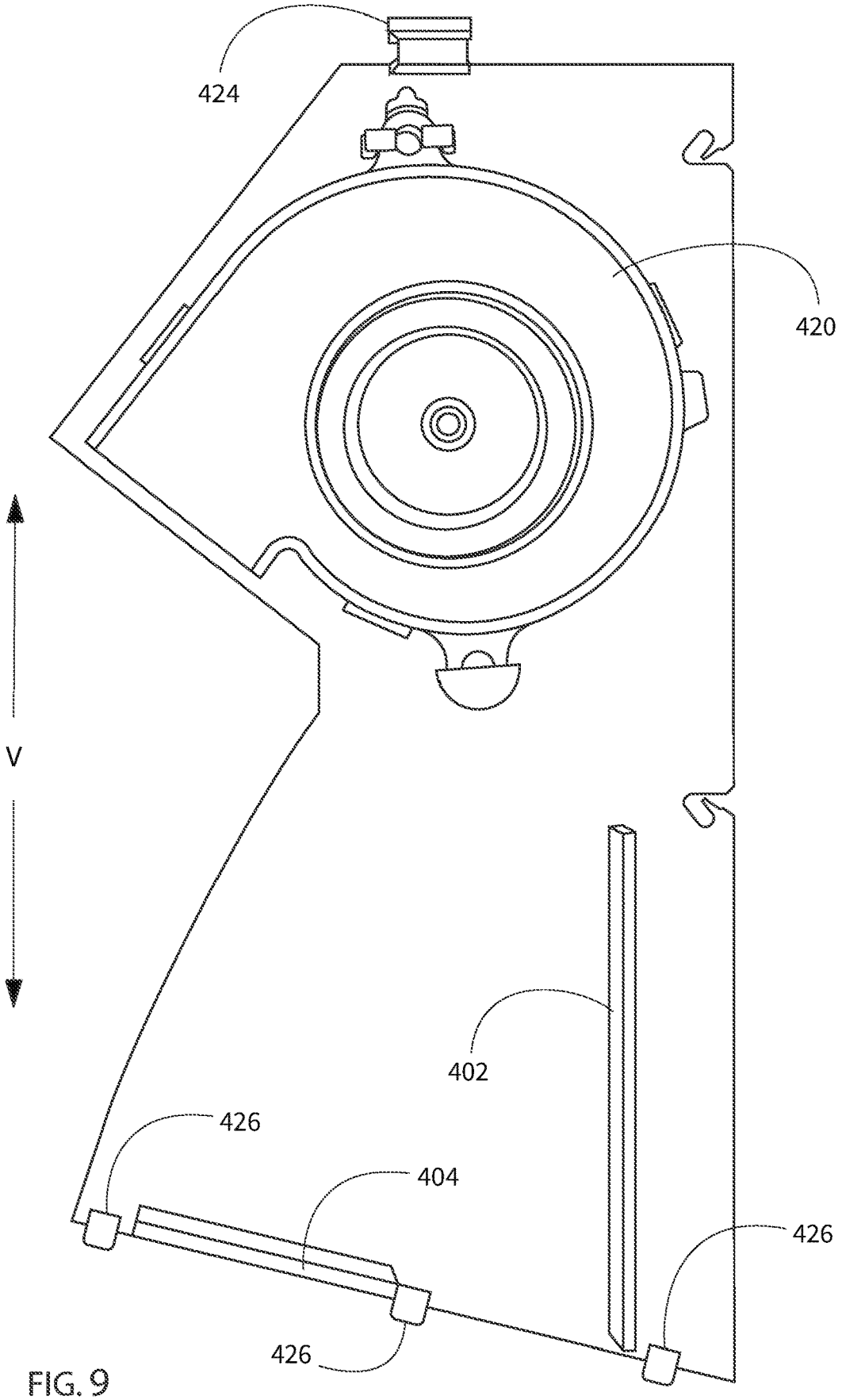
FIG. 9 provides an elevation view of the fan cover of FIG. 8.
Figure 10:
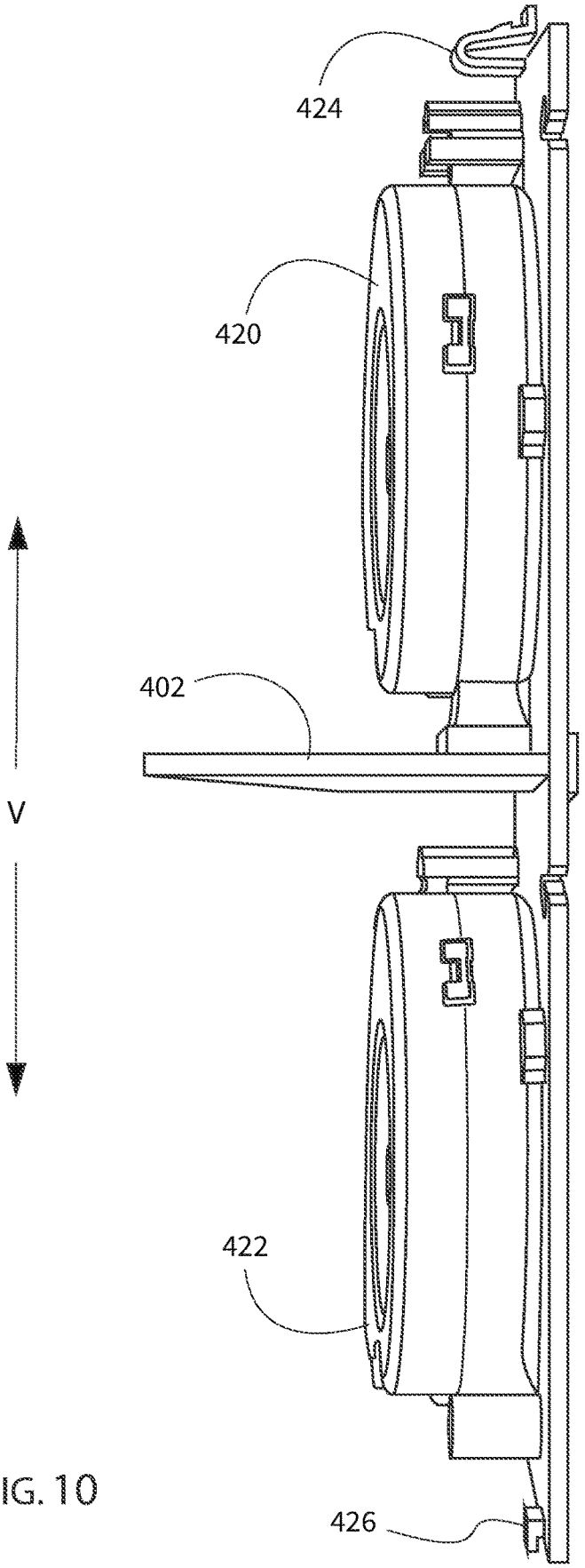
FIG. 10 provides a perspective view of an exemplary fan cover of FIGS. 5 and 7.
Figure 11:
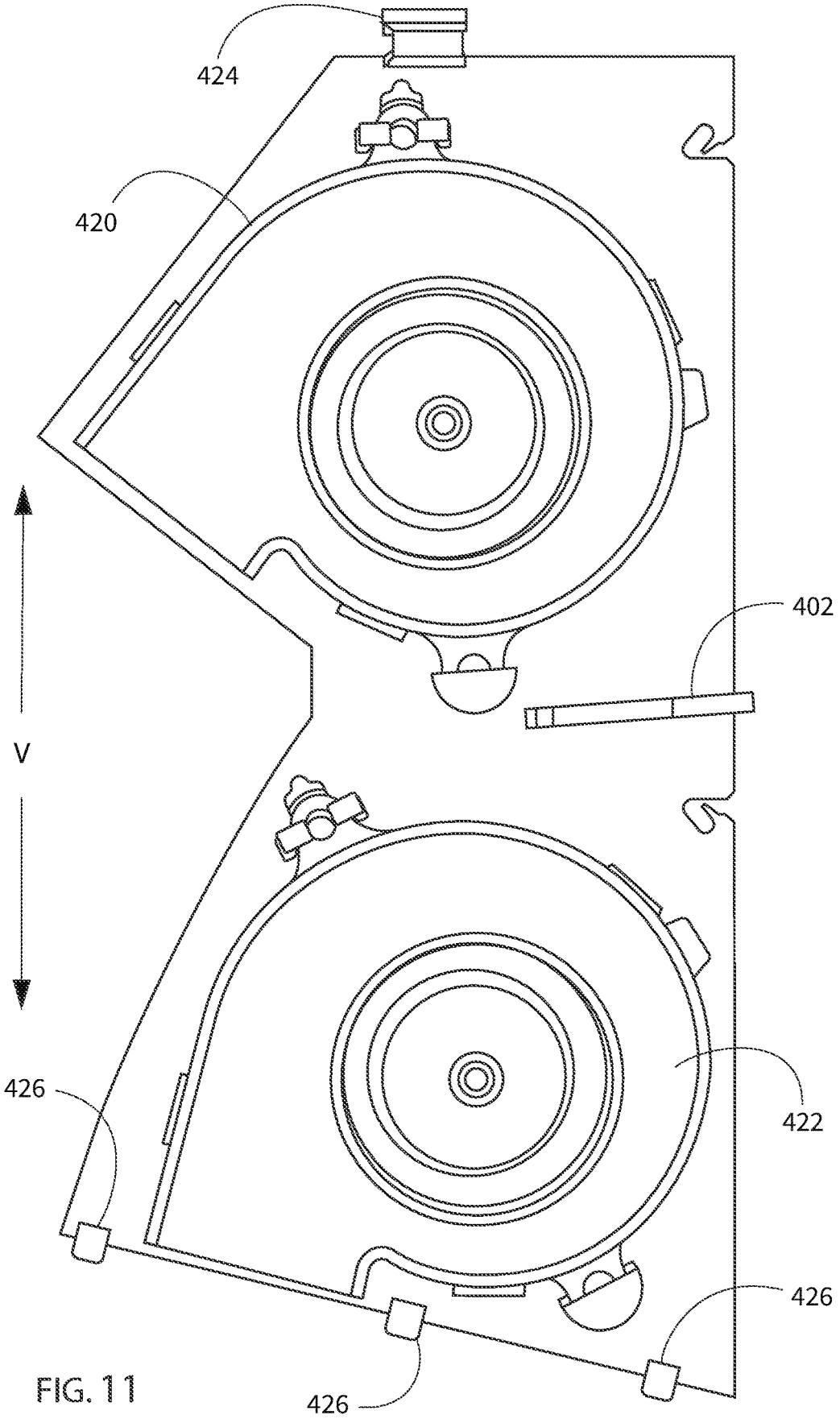
FIG. 11 provides an elevation view of the fan cover of FIG. 10.

FIGS. 8 and 9 depict the first fan cover 400A in isolation, e.g., not mounted in the vent conduit 300, and FIGS. 10 and 11 similarly depict the second fan cover 400B in isolation. As mentioned above, the vent conduit 300 may be configured for removably receiving a selected fan cover 400A or 400B therein, and the fan covers 400A and 400B may be configured for removably mounting in the vent conduit 300. Also as mentioned above, the mounting features on the fan covers 400A and 400B may be the same in order to promote interchangeably mounting the selected one of the first fan cover 400A and the second fan cover 400B in the vent conduit 300 as may be appropriate or desired for the ventilation assembly of a particular dishwashing appliance, and such that each fan cover 400A or 400B—whichever is selected—is mounted within the vent conduit 300 at the same position within the vent conduit 300, e.g., the same position relative to the first inlet 302, second inlet 304, and the outlet 306 of the vent conduit 300. As may be seen in FIGS. 8 through 11, the fan covers 400A and 400B may each include one or more hooks 426 on a first outer peripheral edge of the fan cover 400A and 400B and a flexible tab 424 on a second outer peripheral edge of the fan cover 400A and 400B, such as two hooks 426, or three hooks 426, as illustrated, or more than three hooks 426. Thus, for example, the selected fan cover 400A or 400B may be removably mounted in the vent conduit 300 by engaging the hooks 426 with, e.g., in, the second slots 310 of the vent conduit 300. As illustrated, the second slots 310 may correspond to the hooks 426, e.g., in number and size, such as three hooks 426 (FIGS. 8 through 11) and three second slots 310 (FIGS. 6 and 7). After engaging the hooks 426 with the second slots 310, the fan cover 400A or 400B, e.g., the flexible tab (or tabs) 424 thereon, may then be rotated into engagement with the first slot 308 in the vent conduit 300. Because the tab 424 is flexible, the fan cover 400A or 400B may thus be removably mounted in the vent conduit 300 in that the fan cover 400A or 400B may be removed from the vent conduit 300 after mounting therein by pressing or otherwise bearing on the flexible tab 424 to disengage it from the first slot 308 and thereafter remove the fan cover 400A or 400B from the vent conduit 300. In additional embodiments, the arrangement of the removable mounting features on the vent conduit 300 and the fan covers 400A and 400B may be reversed, e.g., tabs and/or hooks may be located on the vent conduit 300 and may be engageable with slots in the fan cover 400A or 400B, among numerous other possible variations in the positioning and arrangement of the removable mounting features.

Figure 12:
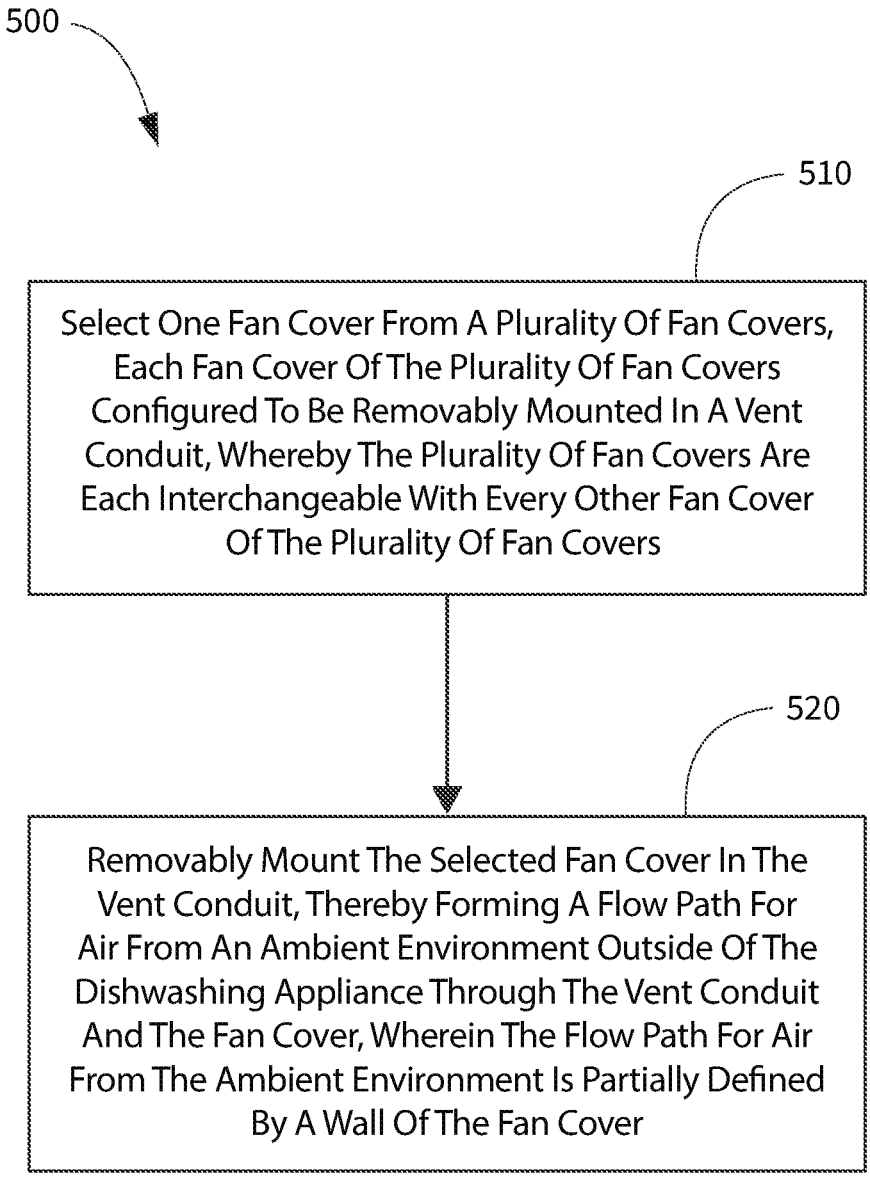
FIG. 12 provides a flow diagram of an exemplary method according to one or more embodiments of the present disclosure.

Turning now to FIG. 12, embodiments of the present disclosure may also include method of assembling a dishwashing appliance and/or a vent assembly thereof, such as the exemplary method 500 illustrated in FIG. 12.

In some embodiments, a method of assembling a dishwashing appliance may include a step 510 of selecting one fan cover from a plurality of fan covers, such as one of the first fan cover 400A and second fan cover 400B described above. For example, in some embodiments, the plurality of fan covers includes at least a first fan cover configured for a single fan and a second fan cover configured for multiple fans. Each fan cover of the plurality of fan covers may be configured to be removably mounted in a vent conduit, such as vent conduit 300. Thus, the plurality of fan covers may each be interchangeable with every other fan cover of the plurality of fan covers.

The exemplary method 500 may, in some embodiments, further include a step 520 of removably mounting the selected fan cover in the vent conduit. With the selected one fan cover so mounted, a flow path for air from an ambient environment outside of the dishwashing appliance is thus formed and defined through the vent conduit and the fan cover. The flow path for air from the ambient environment may be partially defined by a wall of the fan cover, e.g., the wall of the fan cover may form and define one edge of a portion or segment of the flow path for air from the ambient environment through the fan cover.

In some embodiments, the method 500 may further include coupling the vent conduit to a wash tub of the dishwashing appliance, such as coupling an inlet, e.g., inlet 302 described above, of the vent conduit to a vent, e.g., a vent in a side wall of the tub or a vent in an inner wall of a door, also described above. With the vent conduit coupled to the side wall of the wash tub, the vent conduit and the fan cover may thereby be in fluid communication with the wash chamber of the dishwashing appliance, such as in direct fluid communication whereby air from the wash chamber inside the tub flows directly into the vent conduit through the vent at the inlet of the vent conduit.

In some embodiments, e.g., where method 500 includes the vent conduit coupling step described above, the flow path for air from the ambient environment thereby defined by the first fan cover may overlap with a flow path for air from a wash tub of the dishwashing appliance through the first fan cover defined by the first fan cover, while the flow path for air from the ambient environment thereby defined by the second fan cover may be separate and isolated from a flow path for air from a wash tub of the dishwashing appliance through the second fan cover defined by the second fan cover. For example, when the first fan cover is mounted in the vent conduit, and the vent conduit is then coupled to the side wall of the wash tub as described, the flow path for air from the ambient environment that is defined as a result of such coupling may overlap with a flow path for air from a wash tub of the dishwashing appliance through the first fan cover defined by the first fan cover. As an additional example, when the second fan cover is mounted in the vent conduit, and the vent conduit is then coupled to the side wall of the wash tub as described, the flow path for air from the ambient environment that is defined as a result of such coupling may be separate and isolated from a flow path for air from a wash tub of the dishwashing appliance through the second fan cover.

In some embodiments, the first fan cover may include a first inlet of the first fan cover (e.g., first inlet 406 in FIG. 6) configured for fluid communication with a wash tub of the dishwashing appliance whereby the first inlet of the first fan cover is configured to receive humid air from the wash tub and a second inlet (e.g., second inlet 408 in FIG. 6) of the first fan cover configured for fluid communication with the ambient environment whereby the second inlet of the first fan cover is configured to receive dry air from the ambient environment. Also in such embodiments, the first fan cover may include a combined outlet configured to receive a combined flow of humid air from the wash tub and dry air from the ambient environment, whereby the combined outlet is configured for the combined flow to exit the first fan cover at the combined outlet, such as first outlet 410 in FIG. 6. In such embodiments, the second fan cover may include a first inlet of the second fan cover configured for fluid communication with the wash tub of the dishwashing appliance (e.g., first inlet 406 in FIG. 7) whereby the first inlet of the second fan cover is configured to receive humid air from the wash tub and a second inlet (e.g., second inlet 408 in FIG. 7) of the second fan cover configured for fluid communication with the ambient environment whereby the second inlet of the second fan cover is configured to receive dry air from the ambient environment. Such embodiments of the second fan cover may further include a first outlet (e.g., first outlet 410 in FIG. 7) configured for humid air from the wash tub to exit the second fan cover at the first outlet, and a second outlet (e.g., second outlet 412 in FIG. 7) configured for dry air from the ambient environment to exit the second fan cover at the second outlet.

In various embodiments the selected fan cover, whichever fan cover is selected, e.g., first fan cover 400A or second fan cover 400B, may include a first inlet 406 in fluid communication with the wash tub whereby the first inlet 406 receives humid air 1002 from the wash tub and a second inlet 408 in fluid communication with the ambient environment whereby the second inlet receives dry air 1000 from the ambient environment. The selected fan cover, again whichever fan cover 400A or 400B that may be, may further include an outlet, e.g., outlet 410, and a fan mounted therein, e.g., at least first fan 420, and the fan 420 may be positioned and configured to urge air from at least one of the first inlet 406 and the second inlet 408 to the outlet 410. For example, the first fan cover 400A may include only the first fan 420, and the first fan 420 in the first fan cover 400A may be positioned and configured to urge air from both of the first inlet 406 and the second inlet 408 to the first outlet 410, while the second fan cover 400B may include both the first fan 420 and the second fan 422, and the first fan 420 in the second fan cover 400B may be positioned and configured to urge air from only the first inlet 406 to the first outlet 410, e.g., only the wet air 1002 travels through the tub air compartment 416 from the first inlet 406 to the first outlet 410 in the second fan cover 400B, while dry air 1000 entering the second fan cover 400B at the second inlet 408 exits the second fan cover 400B at the second outlet 412.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of assembling a dishwashing appliance, the dishwashing appliance comprising a tub defining a wash chamber therein for receipt of articles for washing and a sump positioned at a bottom of the wash chamber for receiving fluid from the wash chamber, the method comprising:

selecting one fan cover from a plurality of fan covers, each fan cover of the plurality of fan covers configured to be removably mounted in a vent conduit, whereby the plurality of fan covers are each interchangeable with every other fan cover of the plurality of fan covers, wherein the vent conduit is in fluid communication with the wash chamber and with an ambient environment outside of the dishwashing appliance, the vent conduit extending from a tub inlet of the vent conduit to an outlet of the vent conduit, the tub inlet of the vent conduit coupled to a vent in direct fluid communication with the wash chamber whereby the vent conduit receives air directly from the wash chamber at the tub inlet, the outlet of the vent conduit in fluid communication with the ambient environment, the vent conduit extending continuously from the tub inlet of the vent conduit to the outlet of the vent conduit; and mounting the selected fan cover removably in the vent conduit, whereby a first inlet, a second inlet, and at least one outlet of the selected fan cover are within the vent conduit, thereby forming a flow path for air from the ambient environment outside of the dishwashing appliance through the vent conduit and the fan cover, wherein the flow path for air from the ambient environment is partially defined by an inner wall of the selected fan cover.

2. The method of claim 1, wherein the plurality of fan covers comprises a first fan cover configured for a single fan and a second fan cover configured for multiple fans.

3. The method of claim 2, wherein the flow path for air from the ambient environment defined by the first fan cover overlaps with a flow path for air from the tub of the dishwashing appliance through the first fan cover defined by the first fan cover, and wherein the flow path for air from the ambient environment defined by the second fan cover is separate and isolated from a flow path for air from the tub of the dishwashing appliance through the second fan cover defined by the second fan cover.

4. The method of claim 2, wherein the first fan cover comprises the first inlet of the first fan cover configured for fluid communication with the wash chamber tub of the dishwashing appliance, whereby the first inlet of the first fan cover is configured to receive humid air from the wash chamber, the second inlet of the first fan cover configured for fluid communication with the ambient environment, whereby the second inlet of the first fan cover is configured to receive dry air from the ambient environment, and the at least one outlet of the first fan cover is a combined outlet configured to receive a combined flow of humid air from the wash chamber and dry air from the ambient environment, whereby the combined outlet is configured for the combined flow to exit the first fan cover at the combined outlet, and wherein the second fan cover comprises the first inlet of the second fan cover configured for fluid communication with the wash chamber, whereby the first inlet of the second fan cover is configured to receive humid air from the wash chamber, the second inlet of the second fan cover configured for fluid communication with the ambient environment, whereby the second inlet of the second fan cover is configured to receive dry air from the ambient environment, wherein the at least one outlet of the second fan cover is a first outlet configured for humid air from the wash chamber to exit the second fan cover at the first outlet, the second fan cover further comprising a second outlet configured for dry air from the ambient environment to exit the second fan cover at the second outlet.

5. The method of claim 1, wherein removably mounting the selected fan cover in the vent conduit comprises removably engaging a hook of one of the vent conduit and the selected fan cover with a first slot of the other of the vent conduit and the selected fan cover and removably engaging a latch of one of the vent conduit and the selected fan cover with a second slot of the other of the vent conduit and the selected fan cover.

6. A dishwashing appliance, comprising:

a tub defining a wash chamber therein for receipt of articles for washing;

a sump positioned at a bottom of the wash chamber for receiving fluid from the wash chamber; and a vent conduit in fluid communication with the wash chamber and with an ambient environment outside of the dishwashing appliance, the vent conduit extending from a tub inlet of the vent conduit to an outlet of the vent conduit, the tub inlet of the vent conduit coupled to a vent in direct fluid communication with the wash chamber whereby the vent conduit receives air directly from the wash chamber at the tub inlet, the outlet of the vent conduit in fluid communication with the ambient environment, the vent conduit extending continuously from the tub inlet of the vent conduit to the outlet of the vent conduit, a selected fan cover, the vent conduit configured to removably receive the selected fan cover within the vent conduit, whereby a first inlet, a second inlet, and at least one outlet of the selected fan cover are within the vent conduit, wherein the selected fan cover is one of a plurality of fan covers, each fan cover of the plurality of fan covers comprising an inner wall defining a flow path for air from the ambient environment through the respective fan cover of the plurality of fan covers.

7. The dishwashing appliance of claim 6, wherein the vent conduit is configured to removably receive the selected fan cover by removably engaging a hook of one of the vent conduit and the selected fan cover with a first slot of the other of the vent conduit and the selected fan cover and removably engaging a latch of one of the vent conduit and the selected fan cover with a second slot of the other of the vent conduit and the selected fan cover.

8. The dishwashing appliance of claim 6, wherein the plurality of fan covers comprises a first fan cover and a second fan cover, wherein the inner wall of the first fan cover is a first inner wall positioned at a dry air inlet of the first fan cover, the first fan cover comprising a second inner wall obstructing an outlet of a dry air compartment of the first fan cover, wherein the inner wall of the second fan cover separates and isolates a dry air compartment of the second fan cover from a tub air compartment of the second fan cover.

9. The dishwashing appliance of claim 6, wherein the selected fan cover is removably mounted in the vent conduit, the dishwashing appliance further comprising a fan mounted within the selected fan cover.

10. The dishwashing appliance of claim 9, wherein the selected fan cover comprises the first inlet in fluid communication with the wash chamber whereby the first inlet receives humid air from the wash chamber, the second inlet in fluid communication with the ambient environment whereby the second inlet receives dry air from the ambient environment, and wherein the fan is positioned and configured to urge air from at least one of the first inlet and the second inlet to the at least one outlet.

11. The dishwashing appliance of claim 10, wherein the selected fan cover is a first fan cover of the plurality of fan covers, wherein the fan is a single fan in the first fan cover and the single fan is positioned and configured to urge air from both of the first inlet and the second inlet to the at least one outlet.

12. The dishwashing appliance of claim 10, wherein the selected fan cover is a second fan cover of the plurality of fan covers, wherein the at least one outlet of the second fan cover is a first outlet of the second fan cover and the fan is a first fan, further comprising a second outlet of the second fan cover and a second fan, wherein the first fan is positioned and configured to urge air from the first inlet of the second fan cover to the first outlet of the second fan cover and the second fan is positioned and configured to urge air from the second inlet of the second fan cover to the second outlet.

13. The dishwashing appliance of claim 9, wherein the fan is a centrifugal fan.

14. The dishwashing appliance of claim 6, wherein the vent conduit is configured to removably receive the selected fan cover at a position within the vent conduit below the tub inlet of the vent conduit and above the outlet of the vent conduit.

15. The dishwashing appliance of claim 6, wherein the vent conduit is configured to removably receive the selected fan cover at a position above an ambient air inlet within the vent conduit.

16. The dishwashing appliance of claim 6, wherein the vent conduit is configured to removably receive the selected fan cover at a position within the vent conduit below the tub inlet of the vent conduit and above an ambient air inlet within the vent conduit, the ambient air inlet positioned above the outlet of the vent conduit.

* * * * *